US011680710B2

(12) United States Patent
Han

(10) Patent No.: US 11,680,710 B2
(45) Date of Patent: Jun. 20, 2023

(54) FUEL NOZZLE, FUEL NOZZLE MODULE HAVING THE SAME, AND COMBUSTOR

(71) Applicant: DOOSAN ENERBILITY CO., LTD., Changwon-si (KR)

(72) Inventor: Dong Sik Han, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/550,099

(22) Filed: Dec. 14, 2021

(65) Prior Publication Data

US 2022/0214043 A1 Jul. 7, 2022

(30) Foreign Application Priority Data

Jan. 6, 2021 (KR) ..... 10-2021-0001525

(51) Int. Cl.
*F23R 3/28* (2006.01)
*F23R 3/10* (2006.01)
*F23R 3/14* (2006.01)

(52) U.S. Cl.
CPC ..... *F23R 3/286* (2013.01); *F23R 3/10* (2013.01); *F23R 3/14* (2013.01)

(58) Field of Classification Search
CPC .. F23R 3/14; F23R 3/286; F23R 3/045; F23R 3/10; F23D 11/40; F23D 14/62; F23D 14/64
See application file for complete search history.

(56) References Cited

U.S. PATENT DOCUMENTS 5,165,241 A * 11/1992 Joshi ..... F23R 3/14 60/737
5,477,685 A * 12/1995 Samuelson ..... F23R 3/14 60/737
5,675,971 A * 10/1997 Angel ..... F23R 3/286 60/737
5,822,992 A * 10/1998 Dean ..... F23R 3/28 60/737
5,943,866 A * 8/1999 Lovett ..... F23R 3/286 60/725
6,269,646 B1 * 8/2001 Lovett ..... F23R 3/286 60/725

(Continued)

FOREIGN PATENT DOCUMENTS

JP H08135970 A 5/1996
JP H10318541 A 12/1998

(Continued)

OTHER PUBLICATIONS

KR Office Action dated Apr. 26, 2022.

*Primary Examiner* — William H Rodriguez
(74) *Attorney, Agent, or Firm* — Harvest IP Law LLP

(57) ABSTRACT

A fuel nozzle, a fuel nozzle module having the same, and a combustor are provided. The fuel nozzle includes a nozzle cylinder having a space through which fuel flows and a plurality of fuel holes through which the fuel flows in a surface, a shroud spaced apart from the nozzle cylinder and formed to surround the nozzle cylinder in a longitudinal direction of the nozzle cylinder, and a mixing flow path formed between the nozzle cylinder and the shroud to mix the fuel supplied through the plurality of fuel holes and compressed air supplied from a compressor.

9 Claims, 11 Drawing Sheets

(56) References Cited

U.S. PATENT DOCUMENTS 6,321,541 B1 * 11/2001 Wrubel ..... G11C 7/222 60/740
6,691,516 B2 * 2/2004 Stuttaford ..... F23R 3/286 60/737
6,698,207 B1 * 3/2004 Wiebe ..... F23R 3/286 60/737
6,705,087 B1 * 3/2004 Ohri ..... F23R 3/14 60/748
6,722,132 B2 * 4/2004 Stuttaford ..... F23R 3/36 60/737
6,898,937 B2 * 5/2005 Stuttaford ..... F23R 3/286 60/737
6,915,636 B2 * 7/2005 Stuttaford ..... F23R 3/36 60/737
6,931,853 B2 * 8/2005 Dawson ..... F23R 3/286 60/725
7,707,833 B1 * 5/2010 Bland ..... F23R 3/286 60/737
7,908,864 B2 * 3/2011 Haynes ..... F23C 7/004 60/39.463
9,341,375 B2 * 5/2016 Kim ..... F23R 3/14
11,022,309 B2 * 6/2021 Roh ..... F23R 3/286
11,143,405 B2 * 10/2021 Han ..... F23R 3/286
2002/0192615 A1 * 12/2002 Moriya ..... F23D 14/02 431/278
2003/0152880 A1 * 8/2003 Eroglu ..... F23D 17/002 431/12
2006/0174631 A1 * 8/2006 Parker ..... F23R 3/283 60/748
2006/0183069 A1 * 8/2006 Bernero ..... F23D 17/002 431/350
2008/0115497 A1 * 5/2008 Eroglu ..... F23C 7/002 60/737
2009/0280443 A1 * 11/2009 Carroni ..... F23D 11/101 60/742
2010/0266970 A1 * 10/2010 Eroglu ..... F23R 3/286 431/9
2011/0173983 A1 * 7/2011 Pinson ..... F23R 3/286 60/742
2011/0265482 A1 * 11/2011 Parsania ..... F23R 3/286 123/527
2012/0125004 A1 * 5/2012 Parsania ..... F23R 3/14 60/737
2012/0180487 A1 * 7/2012 Uhm ..... F23R 3/286 60/737
2013/0104554 A1 * 5/2013 Bode ..... F23R 3/286 60/740
2014/0144142 A1 * 5/2014 Abd El-Nabi ..... F23R 3/286 60/737
2014/0212208 A1 * 7/2014 Schick ..... B23K 1/0012 228/256
2014/0261111 A1 * 9/2014 Cant ..... F23D 14/62 431/75
2014/0338338 A1 * 11/2014 Chila ..... F23D 14/62 60/737
2015/0354825 A1 * 12/2015 Kajimura ..... F23D 11/383 239/408
2016/0032842 A1 * 2/2016 Isono ..... F23R 3/343 60/725
2016/0061453 A1 * 3/2016 Bethke ..... F23R 3/286 60/737
2016/0209040 A1 * 7/2016 Tamura ..... F23R 3/32
2017/0108224 A1 * 4/2017 Beck ..... F23R 3/36
2018/0051632 A1 * 2/2018 Word ..... F23R 3/286
2018/0230956 A1 * 8/2018 Portillo Bilbao .. F02M 61/1806
2019/0285278 A1 * 9/2019 Choi ..... F23R 3/286
2020/0332998 A1 * 10/2020 Prociw ..... F23R 3/32
2021/0010674 A1 * 1/2021 Thariyan ..... F23R 3/14
2021/0088216 A1 * 3/2021 Tada ..... F02C 7/22
2021/0341147 A1 * 11/2021 Wada ..... F23R 3/286
2021/0348763 A1 * 11/2021 Roh ..... F23R 3/16
2022/0163205 A1 * 5/2022 Francis ..... F23D 11/383
2022/0205637 A1 * 6/2022 Estefanos ..... F23R 3/343
2022/0221152 A1 * 7/2022 Han ..... F23R 3/286

FOREIGN PATENT DOCUMENTS

JP 4205199 B2 1/2009
JP 2012149868 A 8/2012
JP 6021705 B2 11/2016
JP 6169920 B2 7/2017
JP 2017166809 A 9/2017
KR 102164622 B1 10/2020
KR 2020011987 A 10/2020
KR 102197130 B1 12/2020

* cited by examiner

FUEL NOZZLE, FUEL NOZZLE MODULE HAVING THE SAME, AND COMBUSTOR

CROSS-REFERENCE TO RELATED APPLICATION

This application claims priority to Korean Patent Application No. 10-2021-0001525, filed on Jan. 6, 2021, the disclosure of which is incorporated by reference herein in its entirety.

BACKGROUND

Field

Apparatuses and methods consistent with exemplary embodiments relate to a fuel nozzle, a fuel nozzle module having the same, and a combustor.

Description of the Related Art

A gas turbine is a power engine configured to mix and combust air compressed by a compressor and fuel and rotate a turbine with a high-temperature gas generated by combustion. The gas turbine is used to drive a generator, an aircraft, a ship, a train, or the like.

The gas turbine includes a compressor, a combustor, and a turbine. The compressor sucks and compresses external air and delivers the compressed air to the combustor. The air compressed by the compressor is in a high-pressure and high-temperature state. The combustor mixes the compressed air compressed by the compressor with fuel and combusts the mixture to produce combustion gas which is discharged to the turbine. A turbine blade in the turbine is rotated by the combusted gas to generate power. The generated power is used in various fields such as power generation and driving of a mechanical device.

SUMMARY

Aspects of one or more exemplary embodiments provide a fuel nozzle, a fuel nozzle module having the same, and a combustor, which can be applied to a hydrogen turbine using hydrogen as a main raw material while reducing a manufacturing cost.

Additional aspects will be set forth in part in the description which follows and, in part, will become apparent from the description, or may be learned by practice of the exemplary embodiments.

According to an aspect of an exemplary embodiment, there is provided a fuel nozzle including: a nozzle cylinder having a space through which fuel flows and a plurality of fuel holes through which the fuel flows in a surface; a shroud spaced apart from the nozzle cylinder and formed to surround the nozzle cylinder in a longitudinal direction of the nozzle cylinder; and a mixing flow path formed between the nozzle cylinder and the shroud to mix the fuel supplied through the plurality of fuel holes and compressed air supplied from a compressor.

Each of the plurality of fuel holes can be formed to have the same size, and intervals between the plurality of fuel holes can be formed to be the same.

Each of the plurality of fuel holes can be formed to have the same size, and intervals between the plurality of fuel holes can be formed differently.

Each of the plurality of fuel holes can be formed to have a different size, and intervals between the plurality of fuel holes can be formed to be the same.

Each of the plurality of fuel holes can be formed to have a different size, and intervals between the plurality of fuel holes can be formed differently.

According to an aspect of another exemplary embodiment, there is provided a fuel nozzle module including: a plurality of fuel nozzles, each of the plurality of fuel nozzles includes: a nozzle cylinder having a space through which fuel flows and a plurality of fuel holes through which the fuel flows in a surface; a shroud spaced apart from the nozzle cylinder and formed to surround the nozzle cylinder in a longitudinal direction of the nozzle cylinder; and a mixing flow path formed between the nozzle cylinder and the shroud to mix the fuel supplied through the plurality of fuel holes and compressed air supplied from a compressor, wherein a position of the fuel hole included in at least one of the plurality of fuel nozzles is formed at a position different from that of fuel holes included in the other fuel nozzles.

Each of the plurality of fuel holes can be formed to have the same size, and intervals between the fuel holes can be formed to be the same.

Each of the plurality of fuel holes can be formed to have the same size, and intervals between the plurality of fuel holes can be formed differently.

Each of the plurality of fuel holes can be formed to have a different size, and intervals between the plurality of fuel holes can be formed to be the same.

Each of the plurality of fuel holes can be formed to have a different size, and intervals between the plurality of fuel holes can be formed differently.

At least one of the plurality of fuel nozzles can be formed to have a width of the mixing flow path different from each other.

At least one of the plurality of fuel nozzles can be formed to have a width of the mixing flow path different from each other so that a virtual central axis of the shroud and a virtual central axis of the nozzle cylinder do not coincide with each other.

At least one of the plurality of fuel nozzles can include a mixing flow path having a cross-sectional area different from that of mixing flow paths of other fuel nozzles.

According to an aspect of another exemplary embodiment, there is provided a combustor including: a combustion chamber assembly including a combustion chamber in which fuel fluid is combusted; and a fuel nozzle assembly including a fuel nozzle module including a plurality of fuel nozzles that inject the fuel fluid into the combustion chamber, each of the plurality of fuel nozzles includes: a nozzle cylinder having a space through which fuel flows and a plurality of fuel holes through which the fuel flows in a surface; a shroud spaced apart from the nozzle cylinder and formed to surround the nozzle cylinder in a longitudinal direction of the nozzle cylinder; and a mixing flow path formed between the nozzle cylinder and the shroud to mix the fuel supplied through the plurality of fuel holes and compressed air supplied from a compressor.

Each of the plurality of fuel holes can be formed to have the same size, and intervals between the plurality of fuel holes can be the same or different.

Each of the plurality of fuel holes can be formed to have a different size, and intervals between the plurality of fuel holes can be the same or different.

A position of a fuel hole included in at least one of the plurality of fuel nozzles can be formed at a position different from that of fuel holes included in the other fuel nozzles.

At least one of the plurality of fuel nozzles can be formed to have a width of the mixing flow path different from each other.

At least one of the plurality of fuel nozzles can be formed to have a width of the mixing flow path different from each other so that a virtual central axis of the shroud and a virtual central axis of the nozzle cylinder do not coincide with each other.

At least one of the plurality of fuel nozzles can include a mixing flow path having a cross-sectional area different from that of mixing flow paths of other fuel nozzles.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
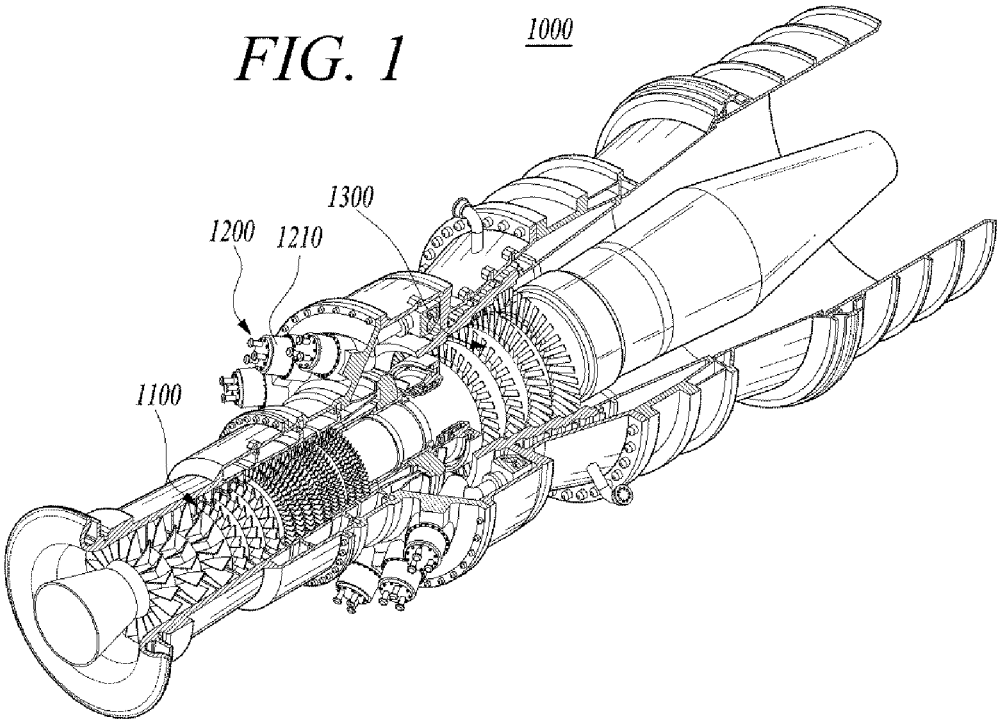
FIG. 1 is a diagram showing an interior of a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Hereinafter, exemplary embodiments will be described in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
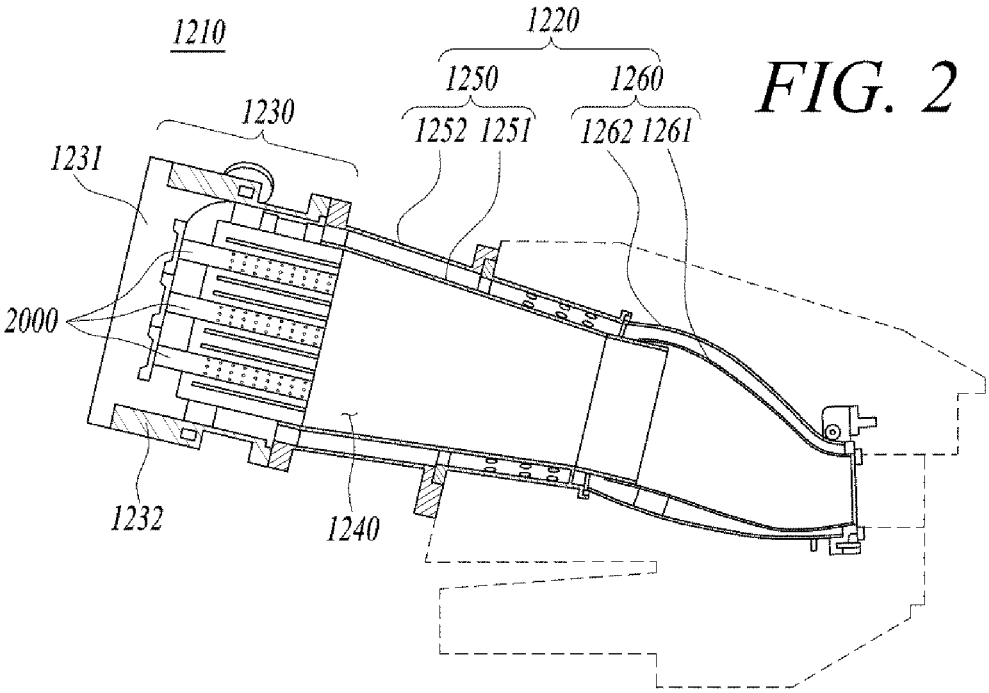
FIG. 2 is a diagram showing a combustor according to an exemplary embodiment.

FIG. 1 is a diagram showing an interior of a gas turbine according to an exemplary embodiment, and FIG. 2 is a diagram showing a combustor according to an exemplary embodiment.

Referring to FIGS. 1 and 2, a gas turbine 1000 includes a compressor 1100 configured to compress introduced air at high pressure, a combustor 1200 configured to mix the compressed air compressed by the compressor 1100 with fuel to combust the mixture, and a turbine 1300 configured to generate a rotation force with a combustion gas generated by the combustor 1200. Here, an upstream and a downstream are defined based on a front and rear of fuel or air flow.

A thermodynamic cycle of the gas turbine can ideally comply with the Brayton cycle. The Brayton cycle is composed of four processes including an isentropic compression (i.e., an insulation compression) process, static pressure rapid heat process, isentropic expansion (i.e., an insulation expansion) process, and static pressure heat dissipation process. That is, in the Brayton cycle, thermal energy may be released by combustion of fuel in the static pressure environment after ambient air is sucked and compressed at high pressure, the high-temperature combusted gas is expanded and converted into kinetic energy, and an exhaust gas with remaining energy is emitted to the atmosphere. As such, the Brayton cycle is composed of four processes including compression, heating, expansion, and heat-dissipation.

The gas turbine 1000 employing the Brayton cycle includes the compressor 1100, the combustor 1200, and the turbine 1300. Although the following description will be described with reference to FIG. 1, the present disclosure may be widely applied to other turbine engines having similar configurations to the gas turbine 1000 illustrated in FIG. 1.

Referring to FIG. 1, the compressor 1100 of the gas turbine may suck and compress air to supply the air for combustion to the combustor 1200 and to supply the air for cooling to a high-temperature region of the gas turbine that is required to be cooled. Because the sucked air is compressed in the compressor 1100 through an insulation compression process, the pressure and temperature of the air passing through the compressor 1100 increases.

The compressor 1100 may be designed in a form of a centrifugal compressor or an axial compressor, and the centrifugal compressor is applied to a small gas turbine whereas a multistage axial compressor is applied to a large gas turbine illustrated in FIG. 1 to compress a large amount of air.

The compressor 1100 is driven using a part of the power output from the turbine 1300. To this end, as shown in FIG. 1, a rotary shaft of the compressor 1100 and a rotary shaft of the turbine 1300 are directly connected. In the case of the large gas turbine 1000, almost half of the output produced by the turbine 1300 may be consumed to drive the compressor 1100. Accordingly, improving the efficiency of the compressor 1100 has a direct effect on improving the overall efficiency of the gas turbine 1000.

The combustor 1200 mixes the compressed air supplied from an outlet of the compressor 110 with fuel to combust the mixture at constant pressure to generate a combustion gas with high energy.

The combustor 1200 is disposed on the downstream of the compressor 1100 and includes a plurality of burner modules 1210 annually disposed around the rotary shaft. Referring to FIG. 2, the burner module 1210 can include a combustion chamber assembly 1220 including a combustion chamber 1240 in which fuel fluid is combusted, and a fuel nozzle assembly 1230 including a plurality of fuel nozzles 2000 that inject the fuel fluid into the combustor 1200.

The gas turbine 1000 may use gas fuel including hydrogen or natural gas, liquid fuel, or a combination thereof. In order to create a combustion environment to reduce the amount of emissions such as carbon monoxide or nitrogen oxides, a gas turbine has a recent tendency to apply a premixed combustion scheme that is advantageous in reducing emissions through lowered combustion temperature and homogeneous combustion even though it is difficult to control the premixed combustion.

For the premix combustion, the compressed air introduced from the compressor 1100 is mixed with fuel in advance in the fuel nozzle assembly 1230, and then enters the combustion chamber 1240. When a premix gas is initially ignited by an igniter and then combustion state is stabilized, the combustion state is maintained by supplying fuel and air.

The fuel nozzle assembly 1230 includes a plurality of fuel nozzles 2000 for injecting fuel fluid, and the fuel nozzle 2000 mixes fuel with air in an appropriate ratio to form a fuel-air mixture having conditions suitable for combustion. The plurality of fuel nozzles 2000 may include a plurality of external fuel nozzles radially disposed around the inner fuel nozzle.

The combustion chamber assembly 1220 includes the combustion chamber 1240 in which combustion occurs, a liner 1250 and a transition piece 1260.

The liner 1250 disposed on a downstream side of the fuel nozzle assembly 1230 may have a dual structure of an inner liner 1251 and an outer liner 1252 in which the inner liner 1251 is surrounded by the outer liner 1252. In this case, the inner liner 1251 is a hollow tubular member, and an internal space of the inner liner 1251 forms the combustion chamber 1240. The inner liner 1251 is cooled by the compressed air introduced into an annular space inside the outer liner 1252.

The transition piece 1260 is disposed on a downstream side of the liner 1250 to guide the combustion gas generated in the combustion chamber 1240 to the turbine 1300. The transition piece 1260 may have a dual structure of an inner transition piece 1261 and an outer transition piece 1262 in which the inner transition piece 1261 is surrounded by the outer transition piece 1262. The inner transition piece 1261 is also formed of a hollow tubular member such that a diameter gradually decreases from the liner 1250 toward the turbine 1300. In this case, the inner liner 1251 and the inner transition piece 1261 can be coupled to each other by a plate spring seal. Because respective ends of the inner liner 1251 and the inner transition piece 1261 are fixed to the combustor 1200 and the turbine 1300, respectively, the plate spring seal may have a structure capable of accommodating expansion of length and diameter by thermal expansion to support the inner liner 1251 and the inner transition piece 1261.

As such, the inner liner 1251 and the inner transition piece 1261 have a structure surrounded by the outer liner 1252 and the outer transition piece 1262, respectively, so that the compressed air may flow into the annular space between the inner liner 1251 and the outer liner 1252 and into the annular space between the inner transition piece 1261 and the outer transition piece 1262. The compressed air introduced into the annular space can cool the inner liner 1251 and the inner transition piece 1261.

The high-temperature and high-pressure combustion gas produced by the combustor 1200 is supplied to the turbine 1300 through the liner 1250 and the transition piece 1260. As the insulation expansion of the combustion gas is made in the turbine 1300, the combustion gas collides with a plurality of blades radially disposed on the rotary shaft of the turbine 1300 so that the thermal energy of the combustion gas is converted into mechanical energy that rotates the rotary shaft. A part of the mechanical energy obtained from the turbine 1300 is supplied as energy necessary for compressing the air in the compressor 1100, and the remaining energy is used as available energy to drive a generator to produce power.

Figure 11:
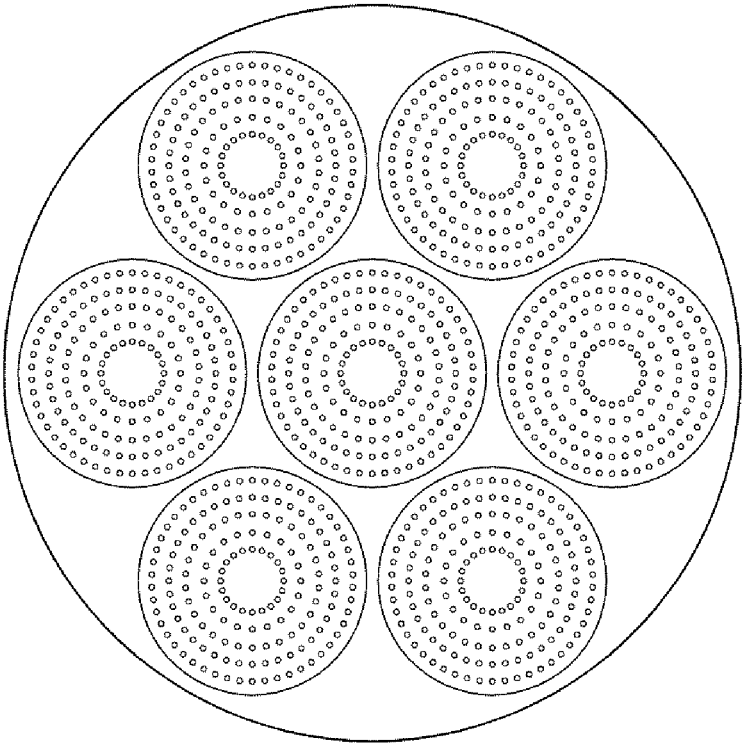
FIG. 11 (Related Art)
FIG. 11 is a plan diagram showing a micro-mixer used in a hydrogen turbine according to a related art.

Meanwhile, recently, a fuel nozzle that lowers the ratio of natural gas and increases the ratio of hydrogen has been studied. A gas turbine that uses fuel with an increased hydrogen rate is referred to as a 'hydrogen turbine'. As a fuel nozzle used in the hydrogen turbine, a micro-mixer as shown in FIG. 11 is used. However, there are disadvantages in that the micro-mixer has a very small size of several millimeters or less, and its shape is very complicated for reasons such as eliminating the risk of flashback and increasing manufacturing cost. The present disclosure provides a fuel nozzle that can be applied to a hydrogen turbine using hydrogen as a main raw material while removing the disadvantages of the micro-mixer. It is understood that the fuel nozzle is not limited thereto, and can be applied to a gas turbine using natural gas as a main raw material.

Figure 3:
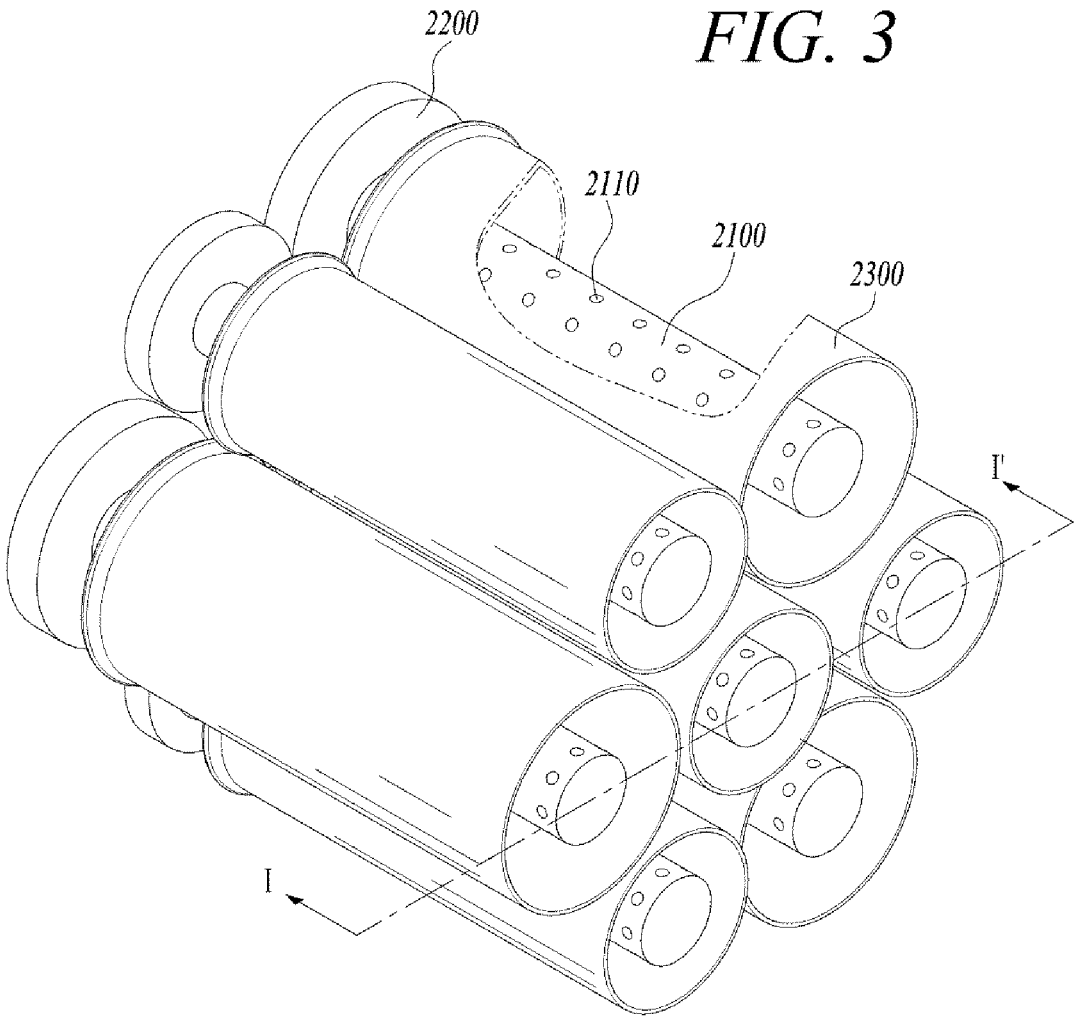
FIG. 3 is a perspective diagram showing a fuel nozzle module including a fuel nozzle according to an exemplary embodiment.
Figure 4:
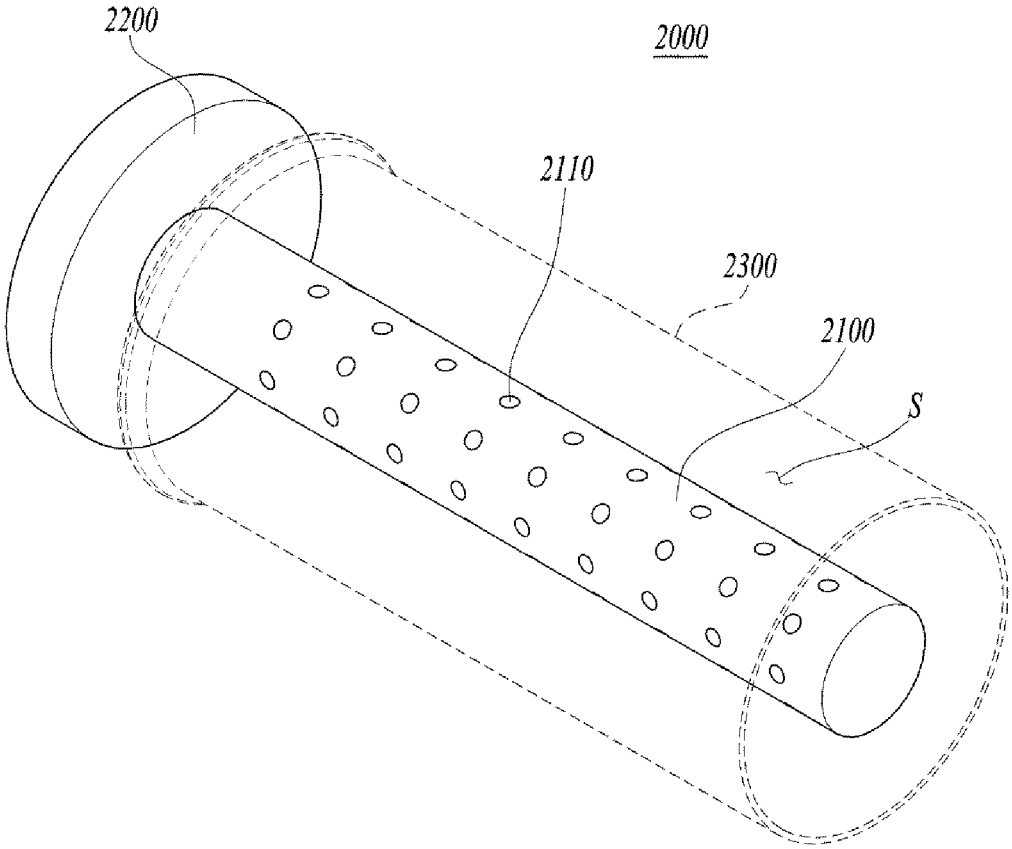
FIG. 4 is a perspective diagram showing a fuel nozzle according to an exemplary embodiment.
Figure 5:
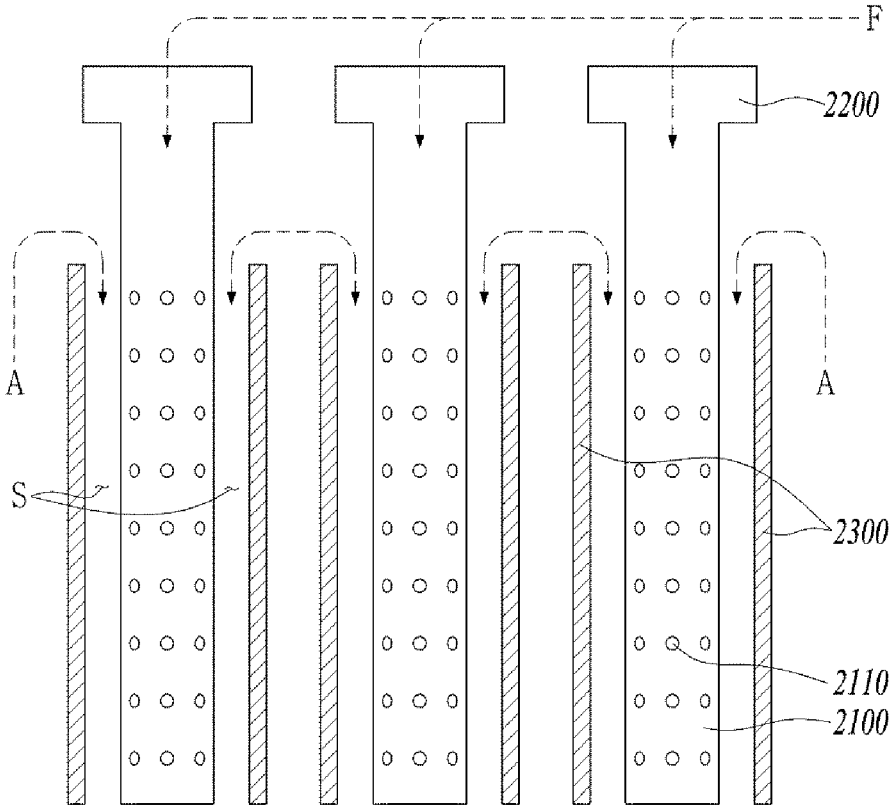
FIG. 5 is a cross-sectional diagram taken along line I-I' of FIG. 3.

FIG. 3 is a perspective diagram showing a fuel nozzle module including a fuel nozzle according to an exemplary embodiment, FIG. 4 is a perspective diagram showing a fuel nozzle according to an exemplary embodiment, and FIG. 5 is a cross-sectional diagram taken along line I-I' of FIG. 3.

Referring to FIGS. 3 to 5, the fuel nozzle 2000 includes a nozzle cylinder 2100, a nozzle flange 2200, and a shroud 2300.

The nozzle cylinder 2100 formed to extend in one direction may supply fuel. The nozzle cylinder 2100 can be formed in a cylindrical shape, but is not limited thereto. The fuel (F) can be hydrogen, natural gas, or a mixed combustion in which hydrogen and natural gas are mixed.

A space through which the fuel (F) flows is formed in the nozzle cylinder 2100, and a plurality of fuel holes 2110 through which the fuel flows are formed in a surface of the nozzle cylinder 2100. The plurality of fuel holes 2110 can be formed from a portion surrounded by the shroud 2300.

Referring to FIG. 5, each of the plurality of fuel holes 2110 can be formed to have the same size and intervals between the fuel holes 2110 may be formed to be the same.

The fuel can be supplied to a mixing flow path (S) formed between the nozzle cylinder 2100 and the shroud 2300 through the plurality of fuel holes 2110 while flowing in a longitudinal direction of the nozzle cylinder 2100.

A head end plate 1231 is coupled to a nozzle casing 1232 at an end of the nozzle casing 1232 constituting an outer wall of the fuel nozzle assembly 1230 to seal the nozzle casing 1232, and can be coupled to a manifold configured to supply fuel to the nozzle cylinder 2100 and associated valves. In addition, the head end plate 1231 supports the fuel nozzle 2000 arranged in the nozzle casing 1232. The fuel nozzle 2000 is fixed to the head end plate 1231 by the nozzle flange 2200 disposed at one end of the nozzle cylinder 2100.

The fuel (F) passes through the head end plate 1231 through a fuel injector to move in a longitudinal direction of the nozzle cylinder 2100 and flows into the mixing flow path (S) through the plurality of fuel holes 2110, is mixed with a compressed air (A), and is injected into the combustion chamber 1240.

The shroud 2300 is spaced apart from the nozzle cylinder 2100 and formed to surround the nozzle cylinder 2100 in the longitudinal direction to form the mixing flow path (S) in which fuel and air can be mixed while flowing. The shroud 2300 can be formed to extend in an extending direction of the nozzle cylinder 2100, and can be formed to be spaced apart from the nozzle cylinder 2100 by a predetermined distance to surround the nozzle cylinder 2100. The cylindrical shroud 2300 is illustrated in the exemplary embodiment. In this case, a cross section of the mixing flow path (S) formed by the nozzle cylinder 2100 and the shroud 2300 can be formed in an annular shape.

The fuel nozzle 2000 according to the exemplary embodiment has a simple structure and can be applied to a hydrogen turbine using hydrogen as a main raw material, thereby significantly reducing manufacturing cost.

Figure 6:
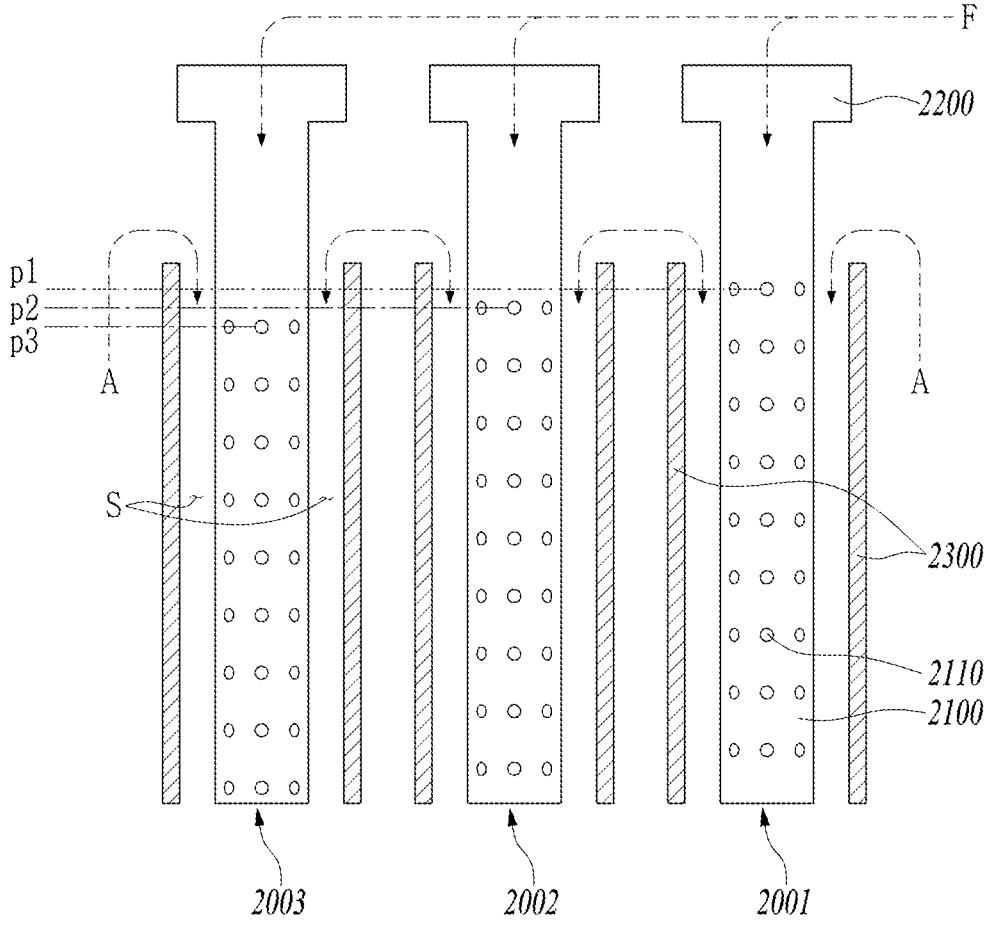
FIGS. 6 to 8 are cross-sectional diagrams showing various modified examples of the fuel nozzle according to another exemplary embodiment.
Figure 7:
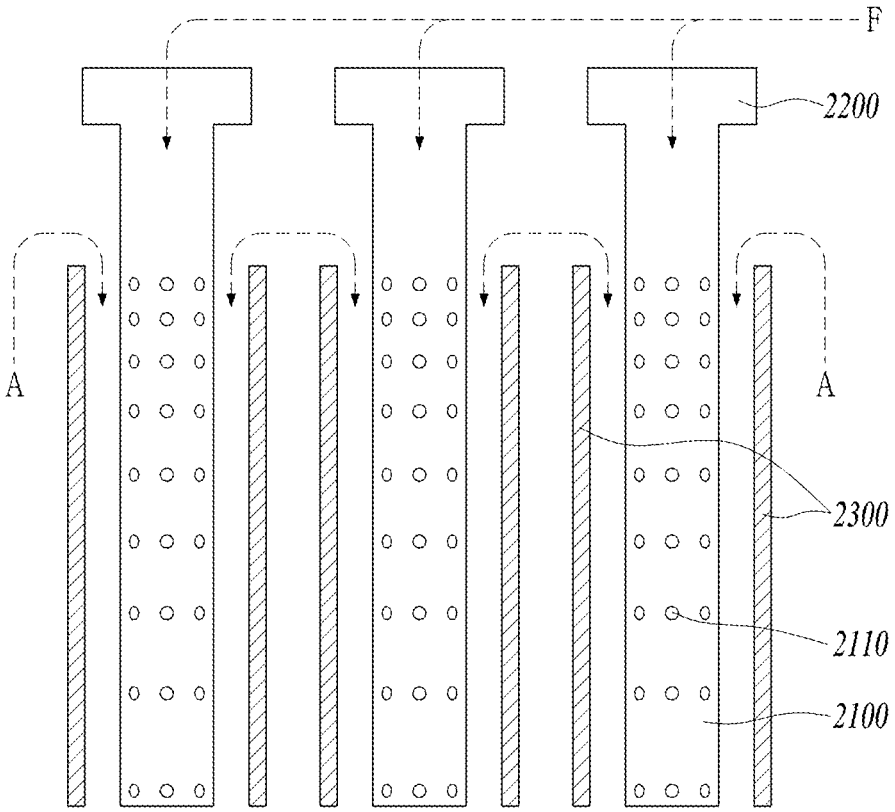
Figure 8:
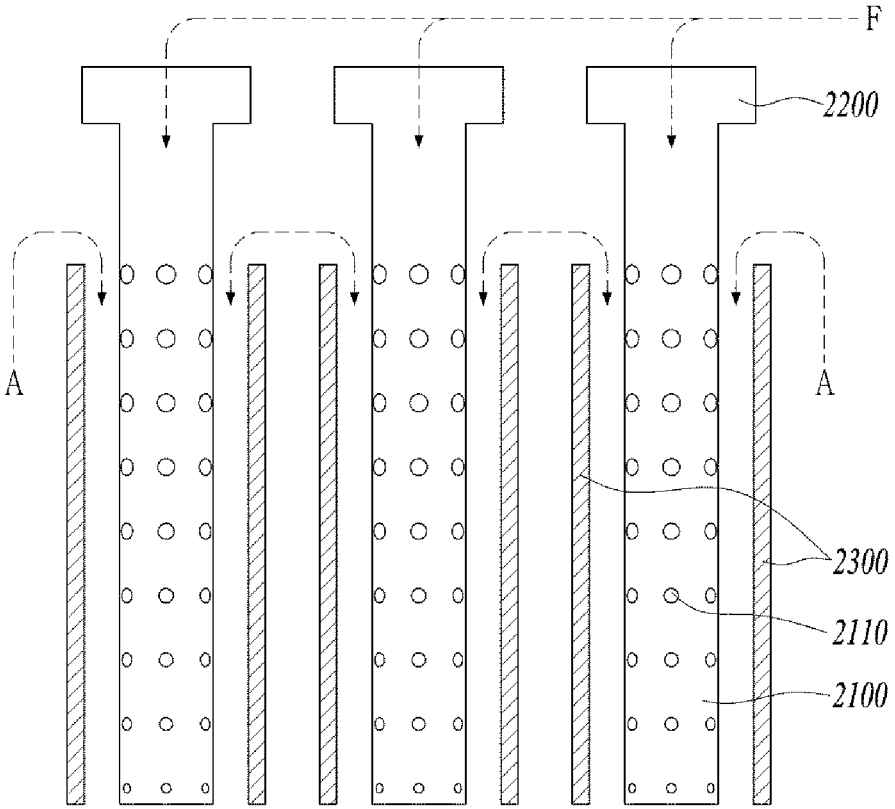

FIGS. 6 to 8 are cross-sectional diagrams showing various modified examples of the fuel nozzle according to another exemplary embodiment.

Referring to FIG. 6, each of the plurality of fuel holes 2110 can be formed to have the same size, and the spacing between the plurality of fuel holes 2110 can be formed to be the same, but positions of the plurality of fuel holes 2110 can be different for each fuel nozzle. For example, a position (P1) of a first fuel hole of a first fuel nozzle 2001 and a position (P2) of a first fuel hole of a second fuel nozzle 2002 can be formed differently. Also, a position (P1) of the first fuel hole of the second fuel nozzle 2002 and a position (P3) of a first fuel hole of a third fuel nozzle 2003 can be formed differently. That is, the position of the first fuel hole of a $n^{th}$ fuel nozzle and the position of the first fuel hole of a $(n+1)^{th}$ fuel nozzle can be formed differently.

In each of the fuel nozzles 2001, 2002, and 2003, the positions of the fuel holes 2111, 2112, and 2113 are formed differently, and the number of high-frequency vibrations in each of the fuel nozzles 2001, 2002, and 2003 generated by the fuel containing hydrogen can be different. Therefore, it is possible to solve the problem of combustion instability caused by high-frequency resonance generated by the fuel containing hydrogen.

Referring to FIG. 7, each of the plurality of fuel holes 2110 can be formed to have the same size, but the intervals between the plurality of fuel holes 2110 can be formed to be different from each other. For example, a distance between the fuel holes 2110 can be formed to gradually increase toward the combustion chamber 1240 located at a rear end of the fuel nozzle 2000.

That is, as the fuel hole 2110 is formed, a large amount of fuel (F) and compressed air (A) can be mixed in an upstream of the mixing flow path (S), and a small amount thereof can be mixed in a downstream of the mixing flow path (S), thereby improving mixing efficiency. In other words, when the same amount of fuel is supplied, a large amount of fuel (F) and compressed air (A) can be mixed in the upstream of the mixing flow path (S) and then continue to be mixed while flowing to the downstream of the mixing flow path (S), thereby improving mixing efficiency.

In addition, each of the plurality of fuel holes 2110 is formed to have the same size, but the intervals between the fuel holes 2110 are formed differently, and as shown in FIG. 6, the position of the first fuel hole in the $n^{th}$ fuel nozzle and the position of the first fuel hole in the $(n+1)^{th}$ fuel nozzle can be formed differently.

Referring to FIG. 8, each of the plurality of fuel holes 2110 can be formed to have a different size, but the distance between the fuel holes 2110 can be formed to be the same. For example, a size (i.e., a diameter) of the fuel hole 2110 can be formed to gradually decrease toward the combustion chamber 1240 located at the rear end of the fuel nozzle 2000.

That is, as the fuel hole 2110 is formed, a large amount of fuel (F) and compressed air (A) can be mixed in the upstream of the mixing flow path (S), and a small amount thereof can be mixed in the downstream of the mixing flow path (S), thereby improving mixing efficiency. In other words, when the same amount of fuel is supplied, a large amount of fuel (F) and compressed air (A) is mixed in the upstream of the mixing flow path (S), and then continue to be mixed while flowing to the downstream of the mixing flow path (S), thereby improving mixing efficiency.

In addition, each of the plurality of fuel holes 2110 can be formed to have different size, but the intervals between the fuel holes 2110 are equally formed, and as shown in FIG. 6, the position of the first fuel hole in the $n^{th}$ fuel nozzle and the position of the first fuel hole in the $(n+1)^{th}$ fuel nozzle can be formed differently.

Alternatively, the plurality of fuel holes 2110 can be formed to have different size, and the distance between the fuel holes 2110 can be formed differently. In this case, as shown in FIGS. 7 and 8, a large amount of fuel (F) and compressed air (A) can be mixed in the upstream of the mixing flow path (S) and a small amount thereof can be mixed in the downstream of the mixing flow path (S), thereby improving mixing efficiency.

Figure 9:
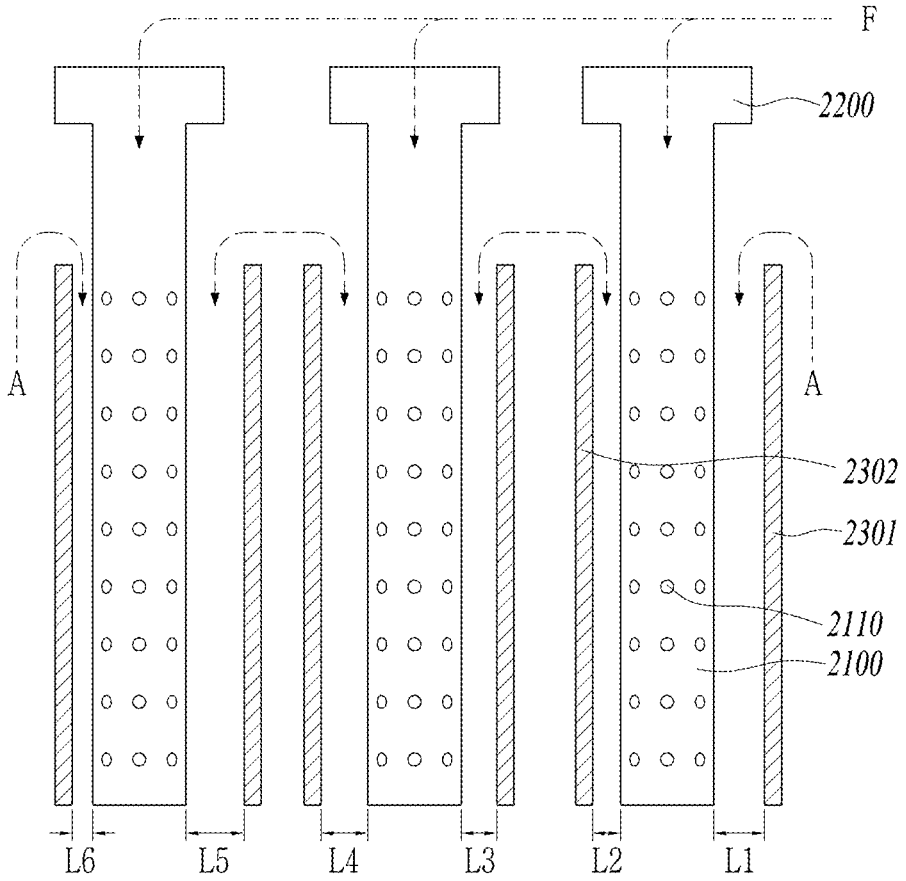
FIG. 9 is a cross-sectional diagram showing a fuel nozzle according to another exemplary embodiment.

FIG. 9 is a cross-sectional diagram showing a fuel nozzle according to another exemplary embodiment.

Referring to FIG. 9, at least one fuel nozzle among the respective fuel nozzles 2001, 2002, and 2003 can have different widths (L1, L2) of the mixing flow path (S). In other words, the positions of the nozzle cylinders 2100 in the shroud 2300 can be formed differently so that the widths (L1, L2) of the mixing flow path (S) between the nozzle cylinder 2100 and the shroud 2300 are different. Here, the "width of the mixing flow path (S)" may be a distance between an outer circumferential surface of the nozzle cylinder 2100 and an inner circumferential surface of the shroud 2300. For example, the widths (L1, L2) of the mixing flow path (S) can be different so that a virtual central axis of the shroud 2300 does not coincide with a virtual central axis of the nozzle cylinder 2100.

That is, at least one fuel nozzle among the plurality of fuel nozzles has different widths (L1 to L6) of the mixing flow path (S) between the nozzle cylinder 2100 and the shroud 2300, so that the number of high-frequency vibrations in each of the fuel nozzles 2001, 2002, and 2003 generated by the fuel containing hydrogen can be different. Therefore, it is possible to solve the problem of combustion instability caused by high-frequency resonance generated by the fuel containing hydrogen.

Figure 10A:
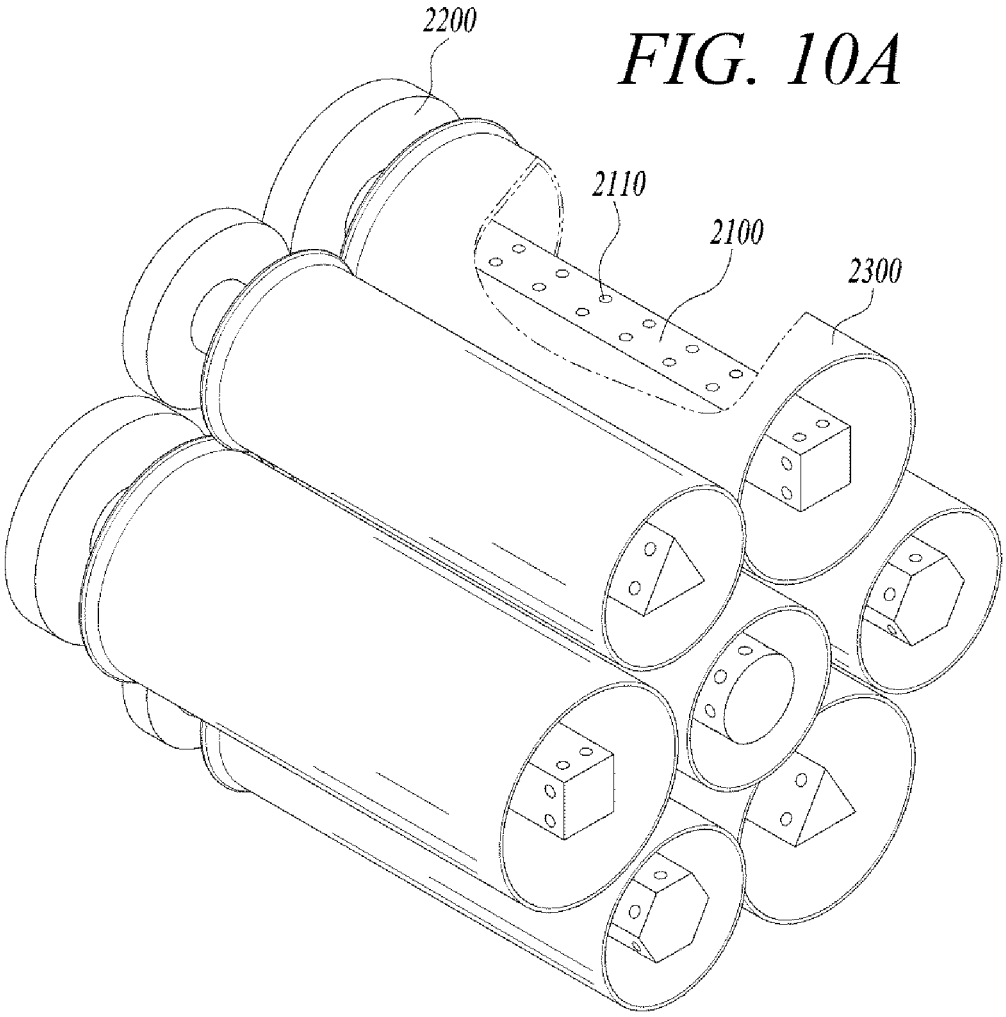
FIG. 10A is a perspective diagram showing a fuel nozzle module according to another exemplary embodiment.
Figure 10B:
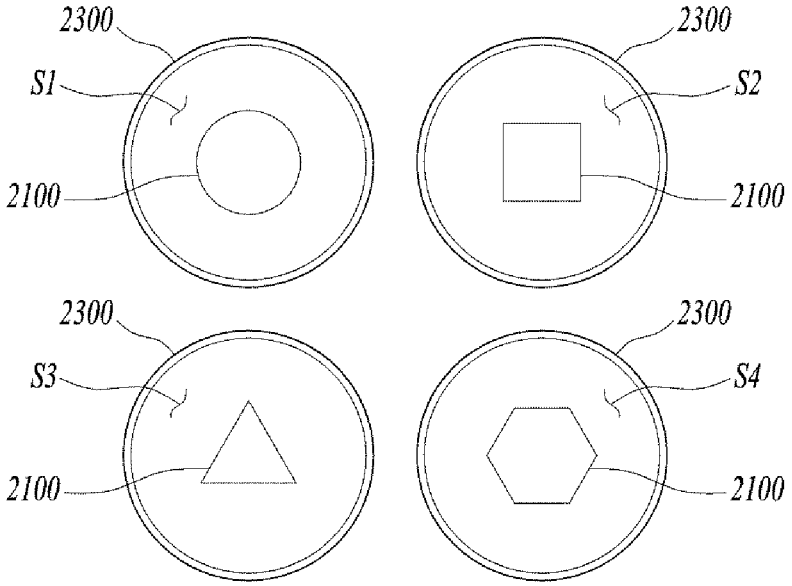
FIGS. 10B and 10C are diagrams showing a state of each fuel nozzle constituting the fuel nozzle module according to the exemplary embodiment as viewed from a downstream side.
Figure 10C:
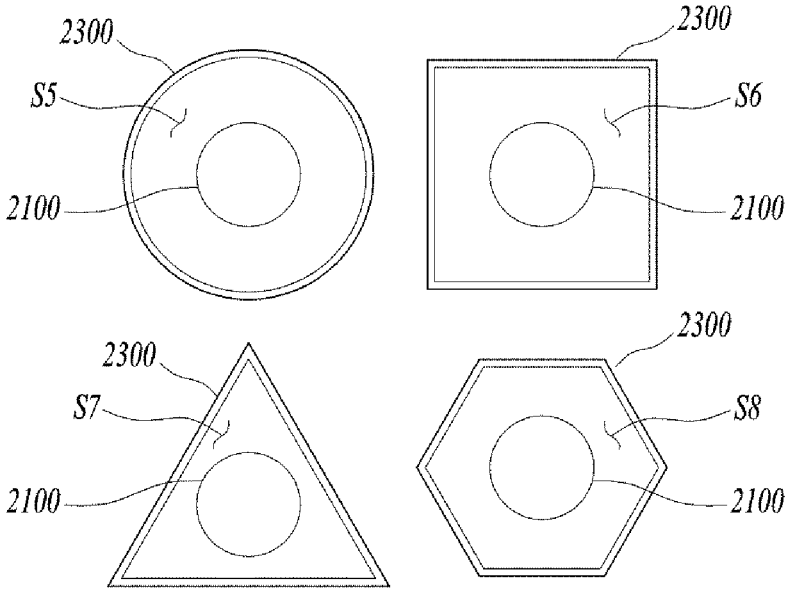

FIG. 10A is a perspective diagram showing a fuel nozzle module according to another exemplary embodiment, and FIGS. 10B and 10C are diagrams showing a state of each fuel nozzle constituting the fuel nozzle module according to the exemplary embodiment as viewed from a downstream side.

Referring to FIGS. 10A to 10C, the fuel nozzle module can include a plurality of fuel nozzles, and at least one fuel nozzle can include mixing flow paths (S1 to S8) having a cross-sectional area different from that of other fuel nozzles.

Referring to FIGS. 10A and 10B, the shroud 2300 is formed in the same shape, and the nozzle cylinder 2100 positioned inside the shroud 2300 is formed in a different shape. For example, the nozzle cylinder 2100 can be formed in a polygonal, circular, rectangular, triangular, or hexagonal shape. In addition, even if the shape of the nozzle cylinder 2100 is the same, a case in which the size of the nozzle cylinder 2100 is different may be included.

Referring to FIG. 10C, the nozzle cylinder 2100 is formed in the same shape, but the shroud 2300 is formed in different shapes. For example, the shroud 2300 can be formed in a polygonal shape such as a circular, a rectangular, a triangular, or a hexagon. In addition, even if the shape of the shroud 2300 is the same, a case in which the size of the shroud 2300 is different may be included.

It is understood that the shapes of the nozzle cylinder 2100 and the shroud 2300 are not limited to those shown in FIGS. 10A to 10C.

As shown in FIGS. 10A to 10C, the cross-sectional area of the mixing flow paths (S1 to S8) formed between the nozzle cylinder 2100 and the shroud 2300 can be changed by combining the shape of the nozzle cylinder 2100 or the shroud 2300, so that the number of high-frequency vibrations in each fuel nozzle generated by the fuel containing hydrogen can be different. Therefore, it is possible to solve the problem of combustion instability caused by high-frequency resonance generated by the fuel containing hydrogen.

While one or more exemplary embodiments have been described with reference to the accompanying drawings, it will be apparent to those skilled in the art that various modifications and variations can be made through addition, change, deletion, or substitution of components without departing from the spirit and scope of the disclosure described in the appended claims, and these modifications and changes fall within the spirit and scope of the disclosure as defined in the appended claims.

What is claimed is:

1. A fuel nozzle comprising:

a nozzle cylinder having a space through which fuel flows and a plurality of fuel holes through which the fuel flows in a surface;

a shroud spaced apart from the nozzle cylinder and formed to surround the nozzle cylinder in a longitudinal direction of the nozzle cylinder; and a mixing flow path formed in an annular shape between the nozzle cylinder and the shroud to mix the fuel supplied through the plurality of fuel holes and compressed air supplied from a compressor, wherein a cross-sectional area of the mixing flow path extending along a longitudinal direction of the mixing flow path is equal from an upstream end to a downstream end of the mixing flow path and the mixing flow path is configured to exclude any component that induces a directional flow of the compressed air; and wherein the plurality of fuel holes is disposed along a plurality of lines in a longitudinal direction of the nozzle cylinder, and diameters of the plurality of fuel holes in each of the plurality of lines are decreased from upstream toward downstream of the nozzle cylinder.

2. The fuel nozzle of claim 1, wherein intervals between the plurality of fuel holes are formed to be the same.

3. The fuel nozzle of claim 1, wherein intervals between the plurality of fuel holes are formed differently.

4. A fuel nozzle module comprising:

a plurality of fuel nozzles, wherein each of the plurality of fuel nozzles comprises:

a nozzle cylinder having a space through which fuel flows and a plurality of fuel holes through which the fuel flows in a surface;

a shroud spaced apart from the nozzle cylinder and formed to surround the nozzle cylinder in a longitudinal direction of the nozzle cylinder; and a mixing flow path formed in an annular shape between the nozzle cylinder and the shroud to mix the fuel supplied through the plurality of fuel holes and compressed air supplied from a compressor, wherein a cross-sectional area of the mixing flow path extending along a longitudinal direction of the of the mixing flow path is equal from an upstream end to a downstream end of the mixing flow path and the mixing flow path is configured to exclude any component that induces a directional flow of the compressed air; and wherein the plurality of fuel holes is disposed along a plurality of lines in a longitudinal direction of the nozzle cylinder, and diameters of the plurality of fuel holes in each of the plurality of lines are decreased from upstream toward downstream of the nozzle cylinder.

5. The fuel nozzle module of claim 4, wherein intervals between the plurality of fuel holes are formed to be the same.

6. The fuel nozzle module of claim 4, wherein intervals between the plurality of fuel holes are formed differently.

7. A combustor comprising:

a combustion chamber assembly comprising a combustion chamber in which fuel fluid is combusted; and a fuel nozzle assembly comprising a fuel nozzle module including a plurality of fuel nozzles that inject the fuel fluid into the combustion chamber, wherein each of the plurality of fuel nozzles comprises:

a nozzle cylinder having a space through which fuel flows and a plurality of fuel holes through which the fuel flows in a surface;

a shroud spaced apart from the nozzle cylinder and formed to surround the nozzle cylinder in a longitudinal direction of the nozzle cylinder; and a mixing flow path formed in an annular shape between the nozzle cylinder and the shroud to mix the fuel supplied through the plurality of fuel holes and compressed air supplied from a compressor, wherein a cross-sectional area of the mixing flow path extending along a longitudinal direction of the of the mixing flow path is equal from an upstream end to a downstream end of the mixing flow path and the mixing flow path is configured to exclude any component that induces a directional flow of the compressed air; and wherein the plurality of fuel holes is disposed along a plurality of lines in a longitudinal direction of the nozzle cylinder, and diameters of the plurality of fuel holes in each of the plurality of lines are decreased from upstream toward downstream of the nozzle cylinder.

8. The combustor of claim 7, wherein intervals between the plurality of fuel holes are the same or different.

9. The combustor of claim 7, wherein a position of a fuel hole included in at least one of the plurality of fuel nozzles is formed at a position different from that of fuel holes included in the other fuel nozzles.

* * * * *